United States Patent [19]

Risberg et al.

[11] Patent Number: 4,646,370

[45] Date of Patent: Mar. 3, 1987

[54] SHROUD FOR LAVATORY TRAP

[75] Inventors: Mark A. Risberg, Sheboygan; Tobin H. Spooner, Sheboygan Falls, both of Wis.

[73] Assignee: Kohler Co., Kohler, Wis.

[21] Appl. No.: 908,962

[22] Filed: Sep. 18, 1986

Related U.S. Application Data

[63] Continuation of Ser. No. 821,852, Jan. 23, 1986, abandoned.

[51] Int. Cl.[4] ..... A47K 17/00

[52] U.S. Cl. ..... 4/661; 4/420; D23/58

[58] Field of Search ..... 4/418, 419, 660, 614, 4/661, 612, 650, 619, 624, 630, 643, 420; D23/58, 68, 69; 248/551, 345; 211/86; 137/359; 312/204, 210; 403/405.1

[56] References Cited

U.S. PATENT DOCUMENTS

| | | | |
|---|---|---|---|
| D. 46,438 | 9/1914 | Mann | D23/58 |
| D. 258,906 | 4/1981 | Doman . | |
| 650,897 | 6/1900 | Hinsdale | 4/418 |
| 664,862 | 1/1901 | Higgins . | |
| 917,454 | 4/1909 | Kelly . | |
| 1,049,913 | 1/1913 | Porter | 4/419 |
| 1,227,165 | 5/1917 | Marin | 4/419 |
| 1,578,849 | 3/1926 | Rogers | 4/648 |
| 1,629,693 | 5/1927 | Foltz . | |
| 1,682,351 | 8/1928 | Rogers . | |
| 1,760,494 | 5/1930 | Hammer et al. | 4/630 |
| 1,773,722 | 8/1930 | Bonner . | |
| 2,094,840 | 10/1937 | Groeniger et al. . | |
| 2,448,798 | 9/1948 | Haberstump et al. . | |
| 2,506,642 | 5/1950 | Jacobi . | |
| 2,567,607 | 9/1951 | Larson . | |
| 2,870,458 | 1/1959 | Bowden . | |
| 3,025,337 | 3/1962 | Leoni . | |
| 3,199,824 | 8/1965 | Chapps | 248/551 |
| 3,207,460 | 9/1965 | Hauser . | |
| 3,382,635 | 5/1968 | O'Gara et al. . | |
| 3,428,968 | 2/1969 | Ory et al. | 4/648 |
| 3,487,478 | 1/1970 | Harris | 4/619 |
| 3,915,524 | 10/1975 | Langston | 4/650 |
| 4,145,769 | 3/1979 | MacFarlane et al. | 4/628 |
| 4,160,295 | 7/1979 | Putyra | 4/420 |
| 4,387,738 | 6/1983 | Bisonaya et al. | 137/359 |

OTHER PUBLICATIONS

Ideal-Standard catalog page, undated, admitted prior art, showing the Ronsal-Nova.

*Primary Examiner*—Stephen Marcus
*Assistant Examiner*—Leo Peters
*Attorney, Agent, or Firm*—Quarles & Brady

[57] ABSTRACT

A shroud apparatus which mounts under a wall-mounted lavatory to enclose the trap of a lavatory is disclosed. The shroud has upper and lower rearward attachment regions which are hidden by the walls of the shroud when the shroud is viewed from the front. The shroud defines a hollow interior portion which is upwardly open to receive the trap. It also includes a shroud fastening element in its upper rearward attachment region and a securing element that cooperates with said shroud fastening element so as to restrict the forward movement of the shroud. A connector is attachable to the bathroom wall and to the lower rearward attachment region of the shroud.

7 Claims, 9 Drawing Figures

FIG. 1
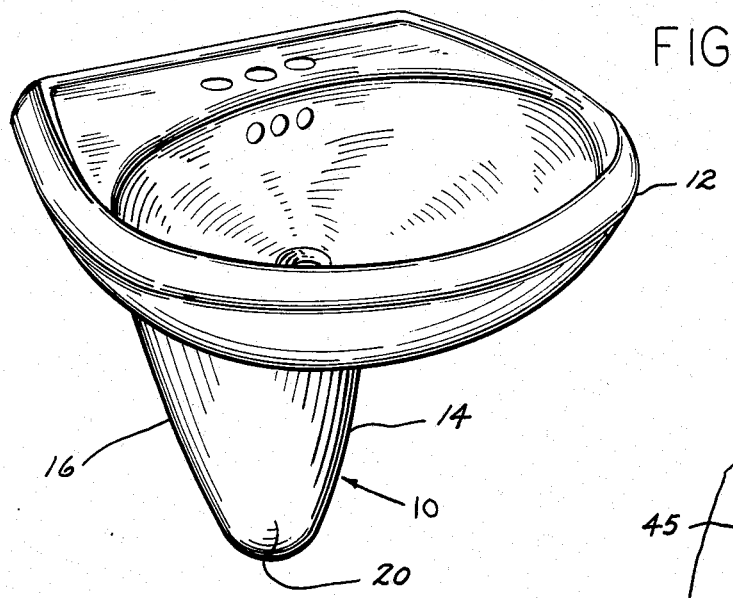
FIG. 2
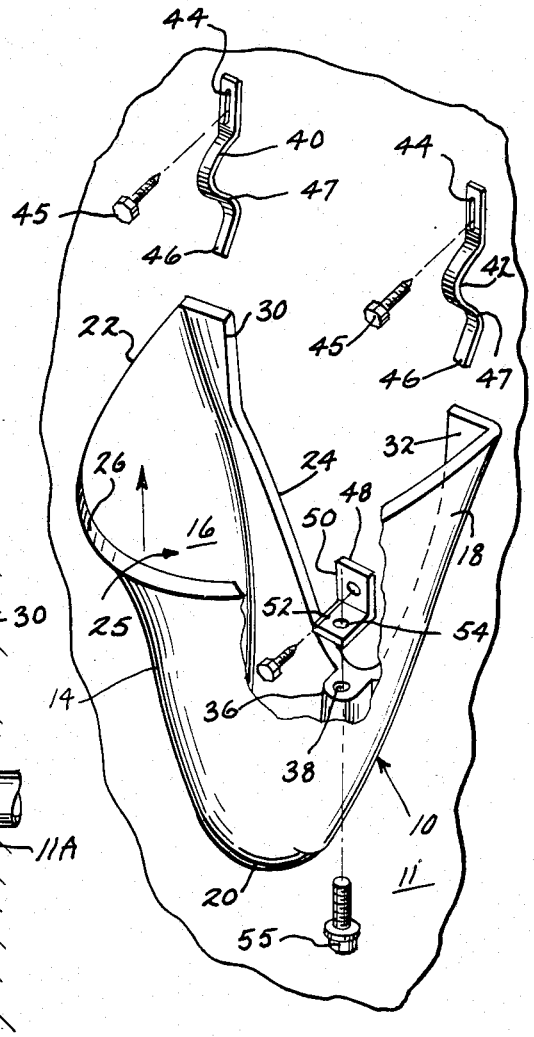
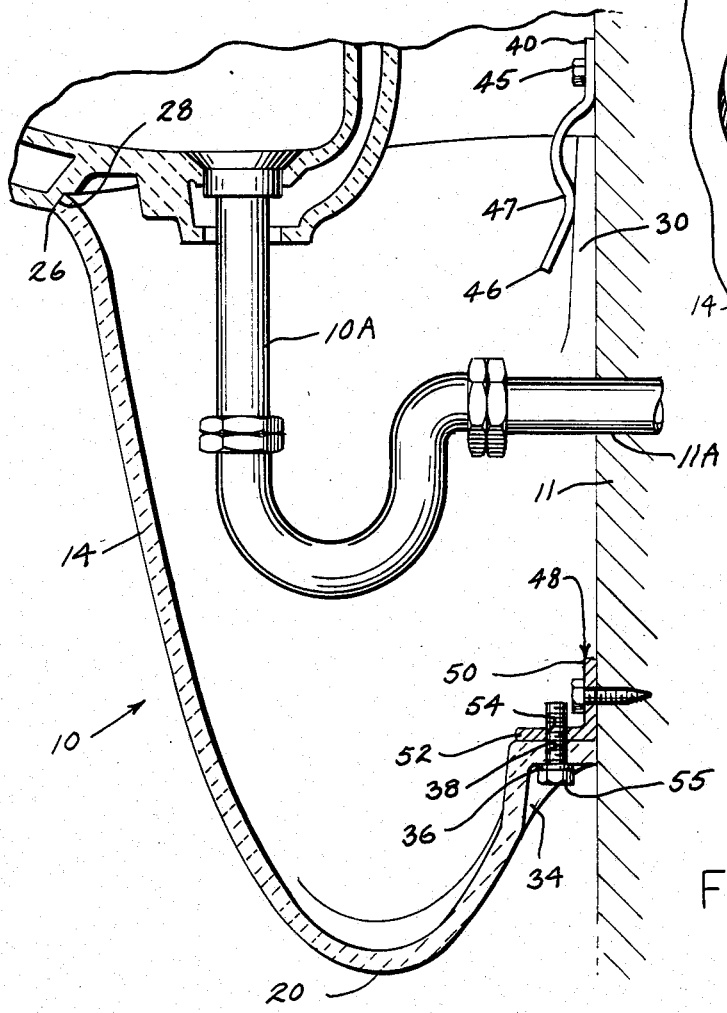
FIG. 3

SHROUD FOR LAVATORY TRAP

This application is a continuation of application Ser. No. 821,852, filed Jan. 23, 1986, now abandoned.

FIELD OF THE INVENTION

This invention relates to a shroud for concealing the trap under a lavatory.

BACKGROUND OF THE INVENTION

Shrouds have been used in the past to cover lavatory traps and to give a decorative appearance to lavatories. One familiar type of shroud is a pedestal, which fits underneath the lavatory and extends to the floor. The pedestal usually has a hollow interior into which the trap is inserted, and its weight is supported by the floor on which it stands.

Another type of enclosure which is known is a shroud which fastens to the wall. It is this latter type of wall-supported shroud to which the present invention relates. Prior art shrouds of this type are mounted by means of outwardly projecting flanges having holes for receiving bolts which bolt into the wall. The mechanism for mounting these shrouds is clearly visible, because the bolt heads are visible. This disrupts the highly decorative appearance (which is the main reason for having the shroud in the first place). Therefore, there has been a need in the art for a means for hiding the connection to the wall so as to fulfill the decorative purpose of the shroud. However, some solutions for hiding the connection, such as placing it much higher on the shroud so as to be completely hidden by the lavatory, result in designs which are very difficult to install.

SUMMARY OF THE INVENTION

The present invention provides a shroud for a lavatory trap which mounts on the wall of a building such that the mounting means are not readily visible and such that the shroud can be easily installed.

In one embodiment, the shroud has two side walls and a front wall that define a hollow interior which is upwardly open. The shroud also includes upper and lower rearward attachment regions which are substantially hidden by the shroud walls when the shroud is viewed from the front. There is a shroud fastening element (e.g. a flange) in the upper rearward attachment region which cooperates with a securing element (e.g. a clip) which is positionable above the fastening element, usually on the building wall. One of the elements (e.g. the flange) includes an insert portion and the other a receiving portion (e.g. the clip), so that, when the shroud fastening element is slid toward the securing element, the insert portion is slid into the receiving portion so as to restrict the forward movement of the shroud. Another connector (e.g. a bracket) is attachable to the wall of the building and also to the lower rearward attachment region of the shroud so as to support the shroud.

It is an object of this invention to provide a wall-mounted shroud for a lavatory trap in which the mounting means are not readily visible.

It is a further object of the invention to provide a shroud which can be installed easily.

It is a further object of the invention to provide a shroud which requires only a few simple tools for installation and does not require the use of specialized tools.

BRIEF DESCRIPTION OF THE DRAWINGS

FIG. 1 is a perspective view of a shroud made in accordance with the present invention that has been mounted under a lavatory;

FIG. 2 is an exploded perspective view, partially in section, of the shroud of FIG. 1, including the wall and means for mounting the shroud on the wall;

FIG. 3 is a side sectional view, partially broken away, of the lavatory and shroud of FIG. 1;

DESCRIPTION OF THE PREFERRED EMBODIMENT

Figure 4:
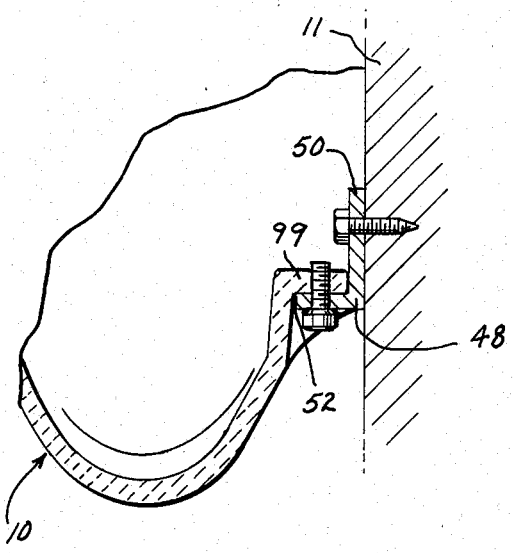
FIG. 4 is an enlarged, broken away side sectional view of the shroud of FIG. 3, with the bracket positioned in an alternative position.

Referring to FIGS. 1–3, the shroud 10 fits below the lavatory 12 in order to conceal the water outlet connection 11A and trap 10A. The shroud or shell has a front wall 14, first and second sides (or side walls) 16 and 18, a nose portion 20 at the bottom of the shroud, a top opening 22, and a back opening 24. The interior of the shroud 10 defines an upwardly open hollow interior portion 25.

Adjacent the top opening 22 is a top lip 26 which fits into a groove 28 in the lavatory so that it appears that the shroud 10 is a part of the lavatory 12 when the parts are installed. On the back of the shroud 10 are first and second flanges 30 and 32 (also called shroud fastening elements), which project inward from the first and second sides 16, 18, toward the second and first sides 18, 16, respectively.

The flanges 30, 32 are adjacent the top opening 22 and are flat so as to lie flat against the bathroom wall 11, which acts as a vertical support for the shroud. The region of the flange(s) may also be referred to as the upper rearward attachment region. The nose 20 is spaced forward from the flanges 30, 32 so as to leave a space or gap between the nose 20 and the wall 11 when the shroud 10 is installed. Between the nose 20 and the flanges 30, 32 is a bridge portion 34 which preferably is higher than the lowest part of the nose 20 and is therefore hidden by the nose 20. In the bridge portion 34 is a recessed area 36 which surrounds an aperture 38 for connecting the shroud 10 to the wall 11. This bridge portion 34 may also be referred to as the lower rearward attachment region.

The mounting apparatus of the shroud 10 includes securing elements in the form of first and second resilient clips (spring clips) 40, 42, each of which has an aperture 44 at one end for mounting the clip on the outside of the building wall 11 by means of bolts or screws 45. Below the aperture 44, each clip (40, 42) defines an S-shaped bend, so that the free ends (or the receiving portions) 46 of the clips 40, 42 are directed downwardly, while being spaced from the wall. This provides a tapered lead-in for the respective flange inserts 30, 32. The spring clips 40, 42 are mounted on the wall horizontally spaced from each other.

An L-shaped bracket (or connector) 48 is mounted on the outside of the wall 11 below the spring clips and approximately midway between them. The L-shaped bracket 48 has a first leg 50 and a second leg 52. The first leg 50 has holes for receiving screws or bolts for fastening the connector 48 to the wall 11. The second leg 52, which is approximately perpendicular to the first leg 50, has a single threaded opening 54 which receives a bolt 55 or other type of fastener for securing the shroud 10 to the wall. The L-shaped bracket 48 is designed to support the weight of the shroud.

In order to install the shroud, the lavatory is first installed and fastened to the wall by a method known in the art, with the usual water outlet hook-up llA and connection to the trap 10A. Next, the spring clips 40, 42 and bracket 48 are mounted on the wall. Then, the shroud 10 is slid upward along the wall, with the trap and water outlet connection entering into the shroud through the top and back openings, 22, 24.

As the shroud 10 is moved upward, the first and second flanges 30, 32 reach the free ends 46 of their respective spring clips 40, 42, and the shroud 10 continues to be moved upward until the first and second flanges 30, 32 are pressed against the wall by the bends 47 of the first and second spring clips 40, 42, respectively. Then, the aperture 38 in the shroud is aligned with the opening 54 in the L-shaped bracket 48, and a bolt 55 is extended through the aperture 38 and is fastened into the bracket 48 in order to support the shroud 10. In the present embodiment, the opening 54 is threaded and a bolt is used. However, other types of retainers are known in the art and could alternatively be used.

It will be noted that the only part of the mounting apparatus which extends outside of the shroud 10 below the lavatory is the head of the bolt 55. Since the bolt head is recessed in the recess 36 and is behind the nose portion 20, the bolt 55 is also hidden from view. Therefore, the means for mounting the shroud 10 are not readily visible after installation. Further, the installation of the clips can be made prior to that of the lavatory to make installation even easier.

Other embodiments of the invention are described herein. The parts of the alternative embodiments are numbered in analogous fashion to correspond to similar parts of the first embodiment.

FIG. 4 shows that the bracket 48 can be mounted so that the second leg 52 is *outside* the shroud 10, but is still hidden from view by the nose 20. The upper portion of the shroud 10 of FIG. 4 is retained in the same manner as in FIGS. 2 and 3. To reach the position shown, the shroud would have to be tipped as it is slid up into the clips so the bracket can be passed by bridge wall 99.

Figure 5:
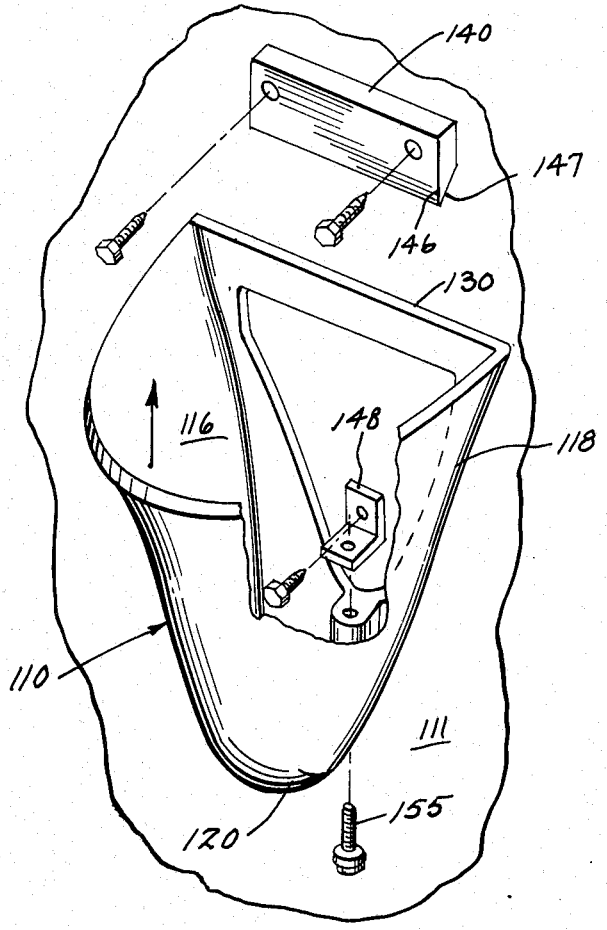
FIG. 5 is a perspective view, partially broken away, of a second embodiment of a shroud assembly made in accordance with the present invention.
Figure 6:
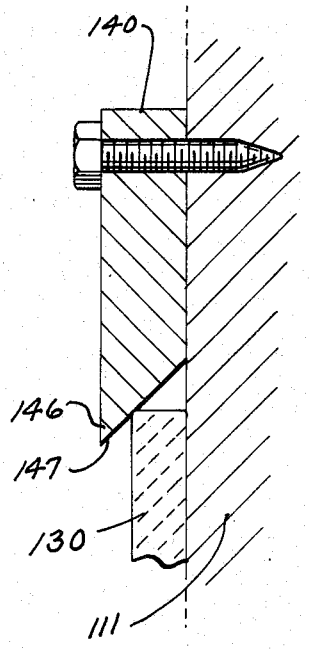
FIG. 6 is an enlarged, broken away side sectional view of the upper portion of the shroud shown in FIG. 5 in an assembled position.

FIGS. 5 and 6 show a third alternative embodiment, in which there is a single flange 130, which extends from the first side 116 toward the second side 118, and is, in fact, connected to the second side 118. This flange 130 is retained by a single central ledge 140, which is not resilient. Instead, the ledge 140 has its free end 146 rigidly directed downward and spaced from the wall 111. The free end 146 has a wedge shape to provide a tapered lead-in 147, to help the installer insert the flange under the free end (or receiving portion) 146. The lower portion of this embodiment is retained in the same manner as in FIGS. 2 and 3, by means of the bracket 148 and bolt 155. Again, some tipping of the shroud is required during installation so the wall 130 can get past the bracket 148.

Figure 7:
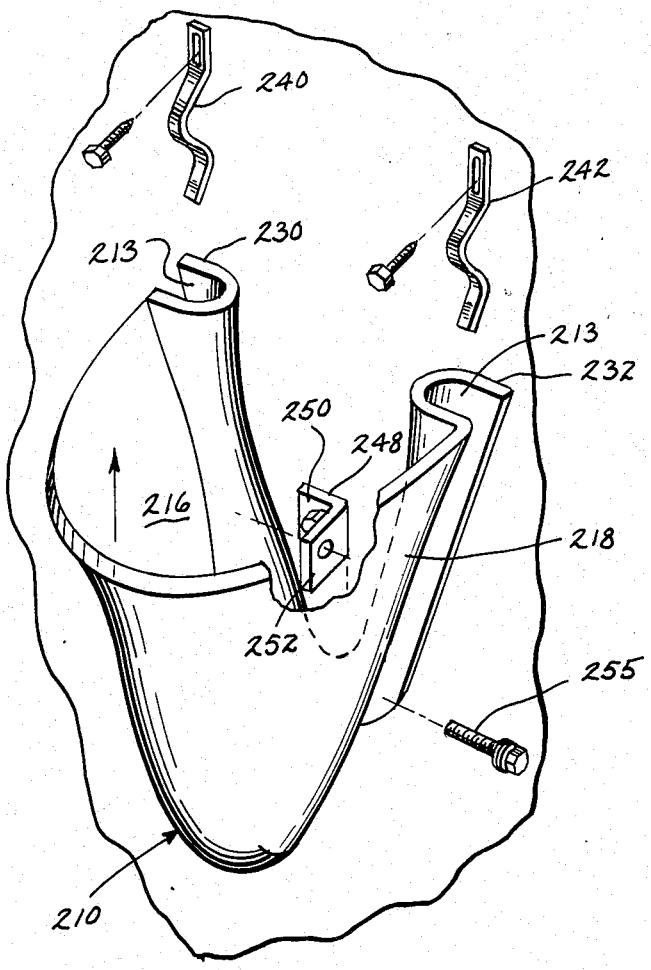
FIG. 7 is a perspective view, partially broken away, of a third embodiment of a shroud assembly made in accordance with the present invention.
Figure 8:
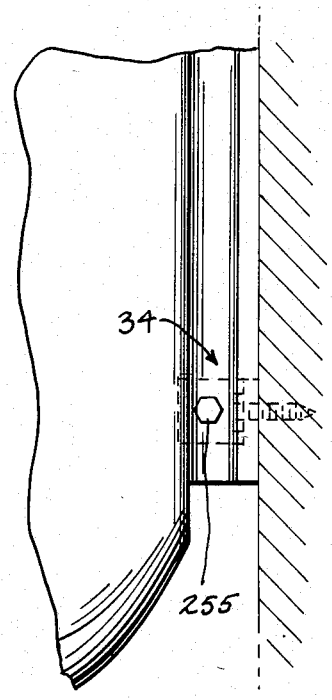
FIG. 8 is a side view of the back portion of the shroud of FIG. 7.

FIGS. 7 and 8 show another alternative embodiment, in which the shroud 210 includes a channel 213 adjacent the flanges 230, 232. The channel 213 provides a recess or bridge portion 34 in its lower rearward region for hiding the bolt 255 which extends *laterally* into the L-shaped bracket 248 for supporting the shroud 210. The clips 240 and 242 receive the flanges 230, 232 as in FIGS. 2 and 3, with the only difference being that the flanges 240, 242 are U-shaped, causing their back surfaces to be spaced further from the sides 216, 218.

Figure 9:
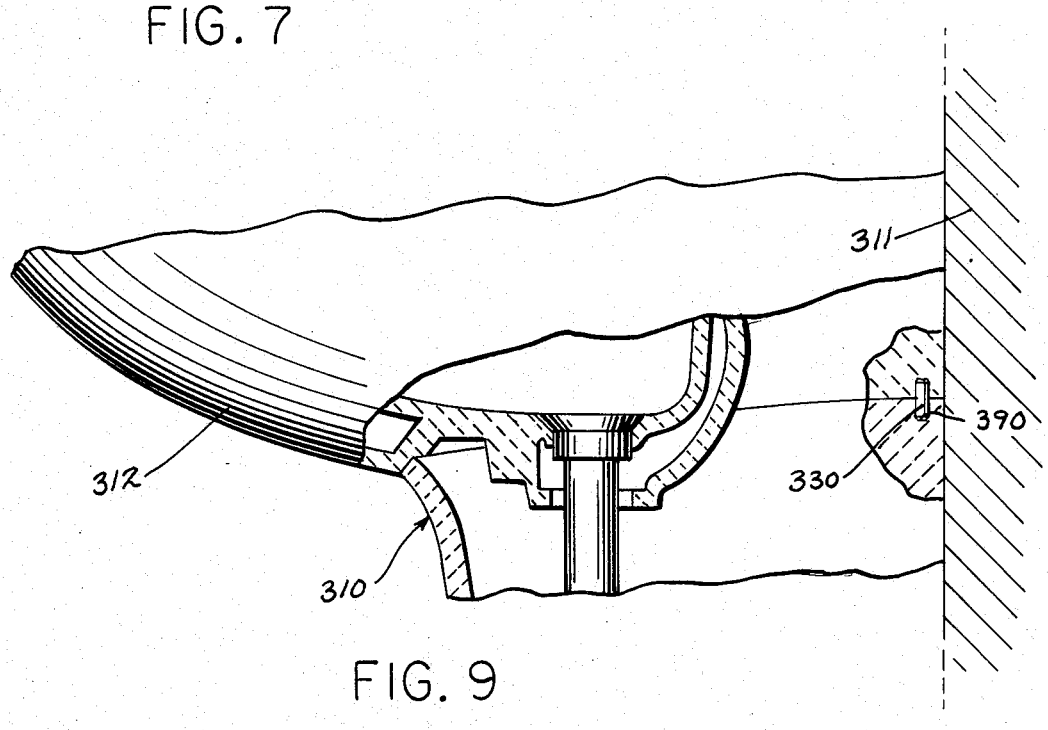
FIG. 9 is a broken away view partially in section of a fourth embodiment of a lavatory and shroud made in accordance with the present invention.

FIG. 9 shows another alternative embodiment, in which, instead of retaining the upper portion of the shroud 310 by a clip which is attached directly to the wall, the upper portion is retained by a pair of pins or securing elements 330 (only one is shown), which project downward from the lavatory 312 (the lavatory, of course, being attached to the wall 311 by suitable means). The shroud 310 has a pair of receptacles or receiving portions 390 which receive their respective inserts or projections 330, when the shroud is slid upward along the wall 311. The lower portion of the shroud 310 is retained as shown in FIGS. 2 and 3.

It will be obvious to those skilled in the art that modifications could be made to the embodiments described above without departing from the scope of the present invention.

What is claimed is:

1. An apparatus for mounting a lavatory trap shroud under a lavatory adjacent a substantially vertical support, comprising:

a shroud having a front wall, side walls, and upper and lower rearward attachment regions which are substantially hidden by said walls when the shroud is mounted under the lavatory and the shroud is viewed from the front, said shroud walls defining a hollow interior portion which is upwardly open;

a shroud fastening element in said upper rearward attachment region of said shroud;

a securing element positionable above said fastening element;

wherein one of said elements includes an insert portion and the other of said elements includes a a receiving portion, so that said insert portion may be slid into said receiving portion when said shroud is moved substantially vertically upward towards said securing element, whereby the forward movement of said shroud may be restricted; and a connector attachable to the substantially vertical support and to said lower rearward attachment region of said shroud so as to be completely surrounded by said walls, hidden from view, and to support said shroud, wherein said shroud fastening element includes an upper flange projecting from one of said side walls, and wherein said securing element includes a resilient clip adapted to be mounted on the substantially vertical support, said clip having a free lower end which serves as said receiving portion for receiving said flange in order to press said flange against said vertical support.

2. An apparatus for mounting a lavatory trap shroud as recited in claim 1, wherein said upper flange projects from one of said side walls toward the other of said side walls.

3. An apparatus for mounting a lavatory trap shroud as recited in claim 2, wherein said lower rearward attachment region has a hole, and said connector has a bracket adapted to be mounted on the substantially vertical support, the bracket defining an aperture adapted to be aligned with said hole, said connector further comprising a bolt adapted to extend into said hole and into said aperture for connecting said bracket to said shroud.

4. An apparatus for mounting a lavatory trap shroud as recited in claim 3, wherein said shroud includes a nose portion which defines the bottom portion of said shroud, said nose portion being spaced forward of said flange, and a bridge portion extehding from said nose portion to said flange, wherein said hole is in said bridge portion.

5. An apparatus for mounting a lavatory trap shroud as recited in claim 4, wherein said upper rearward attachment region includes two flanges, one flange projecting inward from each of said side walls.

6. A shroud mounted on a wall so as to enclose the trap of a lavatory, comprising:

a shell having a front and first and second sides and defining a top opening;

first and second flanges extending from said first and second sides and projecting toward said second and first sides, respectively, said flanges lying adjacent to said top opening and lying flat against said wall;

a nose portion on the bottom of said shell spaced forward of said wall;

a recessed portion of said shell, between said nose portion and said flanges, defining a hole hidden by said nose portion;

first and second spring clips mounted on said wall horizontally spaced from each other, each of said spring clips having a free lower end which receives its respective flange and presses said flange against said wall;

a bracket having first and second legs, said first leg being secured to the outside of said wall, and said second leg defining an aperture aligned with said hole in said shell said bracket recessed in said shell so as to be hidden from view; and a retainer extending through said aligned hole and aperture so as to support said shell.

7. A method for enclosing the trap of a lavatory, comprising the steps of:

mounting first and second clips on a wall horizontally spaced from each other, each of said clips having a free lower end;

mounting a bracket on said wall below said clips, said bracket defining an aperture;

providing a shroud having first and second sides and a front and defining a top opening and including first and second flanges projecting inward from said first and second sides, respectively, said flanges lying adjacent to said top opening, said shroud also including a bottom portion defining a hole;

sliding said shroud upward along said wall so that the trap enters said shroud through said top opening, and continuing to slide said shroud upward until said first and second flanges slide under said free lower ends of said first and second clips, respectively, so as to press said flanges against said wall; and then inserting a retainer through said hole in said bottom portion and into said aperture in said bracket for retaining said shroud on said wall.

* * * * *